US009134084B1

(12) United States Patent
Harrison et al.

(10) Patent No.: US 9,134,084 B1
(45) Date of Patent: Sep. 15, 2015

(54) FIREARM MUZZLE BRAKE

(71) Applicant: RHF Firearm Products, LLC, San Antonio, TX (US)

(72) Inventors: Ronald T Harrison, Devine, TX (US); John L Frizzell, San Antonio, TX (US); Jeffrey A Robinson, Fort Collins, CO (US)

(73) Assignee: RHF Firearm Products, LLP, San Antonio, TX (US)

( * ) Notice: Subject to any disclaimer, the term of this patent is extended or adjusted under 35 U.S.C. 154(b) by 0 days.

(21) Appl. No.: 14/247,127

(22) Filed: Apr. 7, 2014

Related U.S. Application Data

(60) Provisional application No. 61/809,369, filed on Apr. 7, 2013.

(51) Int. Cl.
*F41A 21/36* (2006.01)
*F41A 21/34* (2006.01)

(52) U.S. Cl.
CPC ..... *F41A 21/36* (2013.01)

(58) Field of Classification Search
CPC ..... F41A 21/32; F41A 21/38; F41A 21/34; F41A 21/325; F41A 21/36
USPC ..... 42/79; 89/14.1, 14.2, 14.05, 14.4, 14.3; 181/223; 239/499
See application file for complete search history.

(56) References Cited

U.S. PATENT DOCUMENTS

| | | | | | |
|---|---|---|---|---|---|
| 2,101,063 | A | * | 12/1937 | Green | 89/14.2 |
| 2,101,850 | A | * | 12/1937 | Green | 89/14.3 |
| 2,150,161 | A | * | 3/1939 | Green | 89/14.3 |
| 2,165,457 | A | * | 7/1939 | Cutts, Jr. | 89/14.3 |
| 2,625,235 | A | * | 1/1953 | Caulkins | 181/223 |
| 3,409,232 | A | * | 11/1968 | Cholin | 239/499 |
| 4,392,413 | A | | 7/1983 | Gwinn | |
| 4,583,445 | A | | 4/1986 | Blair | |
| 4,869,151 | A | | 9/1989 | Chahin | |
| 5,063,827 | A | * | 11/1991 | Williamson | 89/14.3 |
| 5,367,940 | A | | 11/1994 | Taylor | |
| 5,631,438 | A | | 5/1997 | Martel | |
| 5,814,757 | A | | 9/1998 | Buss | |
| 7,143,680 | B2 | | 12/2006 | Bender | |
| 7,530,299 | B1 | | 5/2009 | Poff | |
| 2012/0246987 | A1 | | 10/2012 | Anthony | |

* cited by examiner

*Primary Examiner* — Samir Abdosh
*Assistant Examiner* — John D Cooper
(74) *Attorney, Agent, or Firm* — William H. Quirk; Daniel A. Rogers; Rosenthal Pauerstein Sandoloski Agather LLP

(57) ABSTRACT

A muzzle brake attachment for a firearm. The muzzle brake utilizes an inner perforated tube approximating or slightly larger than the bore diameter of a firearm barrel, and an un-perforated or substantially un-perforated outer shield tube. The muzzle brake substantially routes exhausted propellant gases out of the forward end of the muzzle brake, effectively controlling felt recoil while stabilizing the muzzle.

2 Claims, 5 Drawing Sheets

FIREARM MUZZLE BRAKE

NON-PROVISIONAL PATENT APPLICATION

This is a non-provisional Patent Application under 37 CFR 1.53(b) and is submitted with an accompanying non-publication request in accordance with 35 U.S.C. §122(b). Accordingly, the subject matter of this application is to be maintained in secrecy until and unless Applicant allows a patent to issue based on this application.

CLAIM OF PRIORITY TO PRIOR APPLICATION

The present application claims the benefit of prior filed U.S. Provisional application Ser. No. 61/809,369, filed Apr. 7, 2013. By this reference, the full disclosure, including the claims and drawings, of U.S. Provisional application Ser. No. 61/809,369, are incorporated herein as though now set forth in its entirety.

BACKGROUND OF THE INVENTION

1. Field of the Invention

The present invention is in the technical field of firearm recoil reducers and recoil stabilizers with compound deflectors for multifaceted redirection of firearm muzzle blasts in order to minimize recoil and stabilize the firearm while firing. More particularly, the present invention relates to recoil-reducing and recoil-stabilizing firearm muzzle brakes.

2. Description of Related Art

Firearm muzzle brakes, or compensators, have long been known in the art. They are devices attached to or integral with the barrel of a firearm, generally at the barrel's muzzle, which are designed so as to redirect the muzzle blast in order to reduce or control the effect of the recoil and/or lessen unwanted movement of the barrel by helping to stabilize the muzzle while firing. If uncorrected, these recoil effects may cause inaccuracies in the targeting of the firearm.

Such muzzle brakes are generally constructed so as to provide for an alternative exit of propellant gases, usually in the form of holes or channels positioned at some angle to the bore of the barrel, to compensate for the tendency of the muzzle to move upward when firing. These holes or channels are designed to exhaust propellant gases in a direction that is generally perpendicular to the longitudinal axis of a firearm barrel. An example of a muzzle brake with multi-faceted muzzle blast redirectors can be seen in U.S. Pat. No. 6,526,698, albeit intended for different uses than the present invention.

In other technical fields, flash suppressors are devices which are attached to the muzzle of a firearm and are designed to reduce the visible signature of expanding gases visible to the shooter. These gases, visible as a flash, are distracting to the shooter and may be temporarily blinding in low-light conditions. Additionally, night vision devices of the type now commonly used by the military may be rendered temporarily inoperable as a result of the short-term saturation of the light sensor mechanism in such night vision devices.

Flash suppressors are generally designed with a series of vent channels that allow propellant gases to exit the barrel of the firearm in a controlled fashion and over a large surface area, thereby dissipating the flash which would otherwise be present from concentrated gases exiting the muzzle end of a barrel behind the projectile at firing. These vent channels, likewise, generally vent propellant gases in a direction that is approximately perpendicular to the longitudinal axis of a firearm barrel.

Both commercially available muzzle brakes as well as many flash suppressors generally function, in part, by exhausting propellant gases to the surrounding atmosphere immediately prior to their exit from the muzzle of a firearm barrel or the attached muzzle brake or suppressor device. This is accomplished by ports or channels either integral with the muzzle end of a barrel or as a unit attached to the muzzle end of a barrel. As a projectile passes through the muzzle brake or flash suppressor, the propellant gases contained behind it are vented through these holes, ports, or channels in an attempt to produce the relative desired effects of controlling muzzle flash, reducing felt recoil, and stabilizing the muzzle at the point of aim. This venting to the surrounding atmosphere is typically done through said holes, ports, or channels at some angle up to perpendicular to the firearm barrel. This exhaust may be visible to the shooter and can temporarily blind associated night vision optics.

Additionally, the effective diameter of commercially available muzzle brakes, suppressors, or compensators, is generally much larger than the diameter of the projectile that is propelled through it, resulting in an inefficient performance of these devices. What is greatly needed is a muzzle brake and flash suppressor which is effective at reducing felt recoil and stabilizing the muzzle. Such a device would ideally have an effective inner diameter as close to the diameter of the projectile being discharged through it in order to provide for maximum effectiveness of the device. Many other benefits, objects and the like will be evident to those of skill in the art as they review these descriptions and put them into practice.

SUMMARY OF THE INVENTION

In this application, the term "proximal" shall mean ends or parts that are closer to the stock of a firearm, in opposite contrast to "distal" ends or parts, which are located farther from the firearm stock. Hence, with respect to attachments that extend the barrel of a firearm, the proximal end of the attachment is the end that is located adjacent to and integral with the firearm barrel, and the "distal" end of the attachment shall mean its end that extends longitudinally furthest away from the muzzle end of a firearm barrel in the intended use configuration.

With respect to other terms used, the term "projectile" shall mean one or more objects propelled by the expansion of gases through the barrel of a firearm upon the igniting or release of a propellant media such as gunpowder or other rapidly expansive material, as in the normal operation of a firearm. The term projectile shall include, but is not limited to, single bullets, sabot rounds, shotgun slugs, multiple shotgun pellets, or any other object capable of being directed through a barrel or other confined space by the expansion of propellant gases.

Embodiments of the present invention typically comprise an outer housing with an integral inner longitudinal bore section (tube), which is slightly larger than the diameter of the intended projectile. In the preferred embodiment, the slightly larger diameter is between 0.001 inches and 0.5 inches larger than the diameter of the bore of the firearm barrel. However, persons of skill in the art would readily recognize that other diameters could serve comparable purposes and should be understood as being within the scope of many expressions of the present invention.

Muzzle brakes embodying the invention are often affixed to the muzzle end of a firearm barrel, typically at the muzzle brake's proximal longitudinal end, while the muzzle brake has a central bore that is open to the atmosphere at the distal end. The inner longitudinal section tube is perforated with a plurality of channels which allow the propellant gases to escape into the plenum between the inner longitudinal bore section and the substantially unperforated outer housing. The substantially unperforated outer housing is generally affixed to the muzzle end of a firearm via an integral threaded connector and approximates the length of the inner perforated bore tube section. Said outer housing is sized to allow the existence of a plenum or space between the inner exhaust tube and the inner surface of said outer housing.

In several embodiments, the outer housing of the muzzle brake is mounted around the inner bore section of the muzzle brake by way of a screw fitting located at the proximal end of the muzzle brake. As is conventional for muzzle brakes, a primary screw fitting attaches the muzzle brake to the muzzle end of a firearm barrel through mating threads located at the muzzle end of the barrel. For alternatives, those of skill in the art will understand that alternative embodiments may use flange couplings or other suitable approaches for operatively connecting the muzzle brake to the barrel and/or for connecting or integrating the outer housing to the inner bore section of the muzzle brake. The proximal end of the muzzle brake preferably creates an enclosed and sealed union between the barrel and the muzzle brake, effectively preventing the exhaust of any propellant gas back along the axis of the barrel toward the shooter. The distal end of said muzzle brake is open to and continuous with the surrounding atmosphere to allow the directed exhaust of propellant gases forward along the longitudinal axis of the barrel.

When a round is discharged in the firearm, the discharged projectile proceeds down the firearm barrel propelled forward by propellant gases produced as a result of the burning of gunpowder or other material. When the projectile breaches the muzzle end of the firearm, it immediately enters the muzzle brake. In one embodiment, the projectile enters initially into an over-sized antechamber prior to entering into the luminal bore of the inner tube. In another embodiment, the projectile directly enters into the luminal bore of the inner tube.

The inner bore is sized to approximate the inner diameter of the barrel bore and outer diameter of the projectile, or is 0.001 inches to 0.50 inches over size to the bore diameter of the firearm barrel. In a preferred embodiment, which is in no way limiting on the scope of the muzzle brake, the diameter is preferably 0.010 to 0.10 inches overbore.

As the projectile traverses the inner bore of the muzzle brake, propellant gases are exhausted circumferentially through exhaust ports located along the inner tube. These exhaust ports may be concentrically or eccentrically located in one or more groups of rows along the longitudinal axis of the inner tube. By way of non-limiting example, these exhaust ports (perforations) are comprised of circular channels of diameters from 0.01 inches through 0.50 inches, preferentially from 0.10 inches to 0.50 inches.

As exhaust gases traverse the exhaust ports and enter into the plenum formed between the inner and outer tubes, they are directed and exhausted forward along the long axis of the barrel and exit the muzzle brake at the distal end which is open and continuous with the surrounding atmosphere.

Many other aspects, features, advantages and the like relating to the invention will be evident to those of skill in the art after reading and contemplating these descriptions and the accompanying drawings and claims, especially when considered in light of the prior art.

DETAILED DESCRIPTION OF THE PREFERRED EMBODIMENTS

Figure 1:
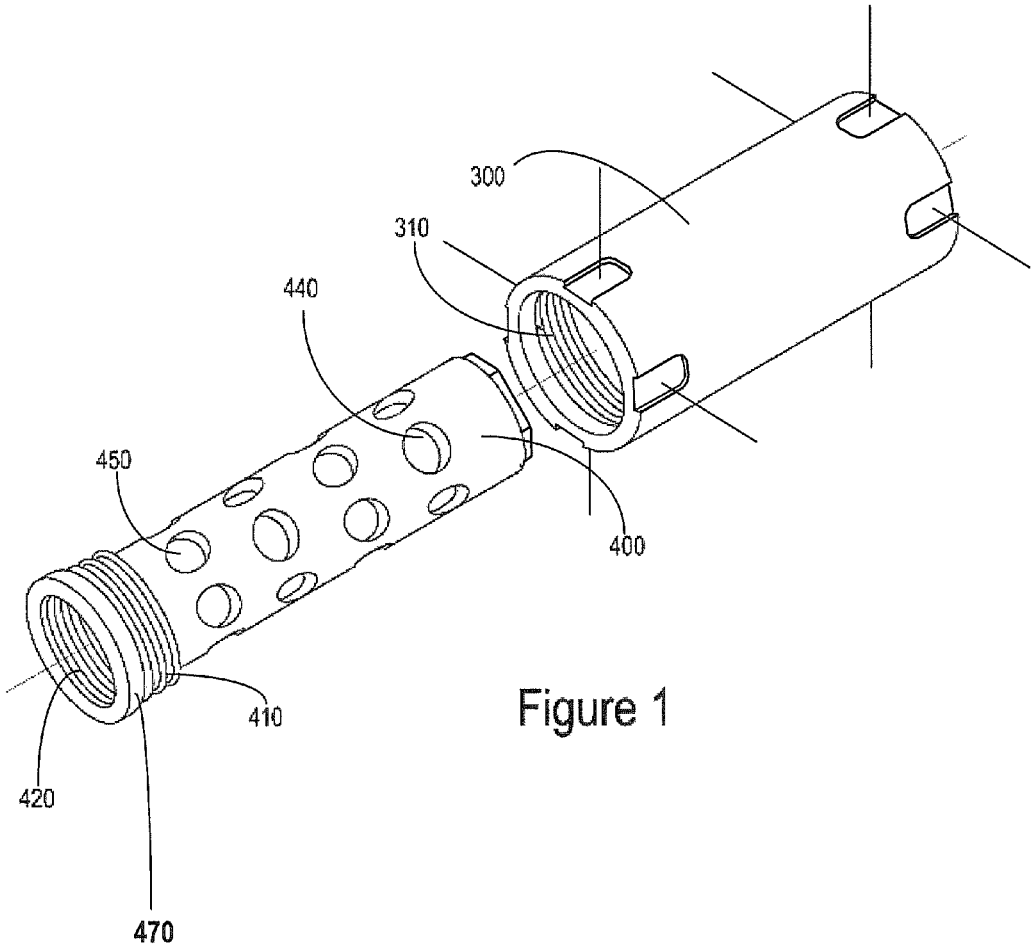
FIG. 1 is a perspective view of the major components of the preferred embodiment.

Reference is first made to FIG. 1 which provides a perspective view of a preferred embodiment of the device of the present invention constructed from steel stock. In the perspective view of FIG. 1, the various external features of muzzle brake 10 are disclosed.

As described above, the basic purpose of muzzle brake 10 is to reduce felt recoil, stabilize the muzzle of a firearm when a projectile is fired, and suppress the normally-occurring muzzle flash, as perceived from the prospective of the person firing, that results when firing a projectile by directing the muzzle flash in a forward direction and away from the person firing. This muzzle flash is a result of expanding gases which propel the projectile along the longitudinal axis of the barrel of a firearm. As these gases exit the muzzle of the barrel, without any device attached to the muzzle end of the barrel, they will disperse in an uncontrolled manner. By attaching muzzle brake 10 to the barrel of a firearm, the expanding gases are exhausted in a direction substantially parallel with the firearm barrel, as shown in FIG. 3.

Referring to FIG. 1, a preferred embodiment of a muzzle brake 10 that is constructed according to the teachings of the present invention is shown, which is comprised of a ported inner tube 400 and an associated outer shield tube 300. Although shown in exploded perspective in FIG. 1, once operatively assembled, ported inner tube 400 is affixed via mating threads 310, 410 into the lumen of outer shield tube 300 in such a fashion so as to create a space, or gas expansion chamber 200 between the outer periphery of ported inner tube 400 and the inner periphery of outer shield tube 300. When operatively assembled, the weight of muzzle brake 10 is approximately one-half pound or more.

Ported inner tube 400 has a series of communications which are formed as exhaust ports 440, 450. Ported inner tube 400 increases the surface area of the firearm muzzle 120. This configuration helps to decrease the velocity of the expanding propellant gases 510 as they exit the firearm muzzle 120 and enter the ported inner tube 400.

Figure 3:
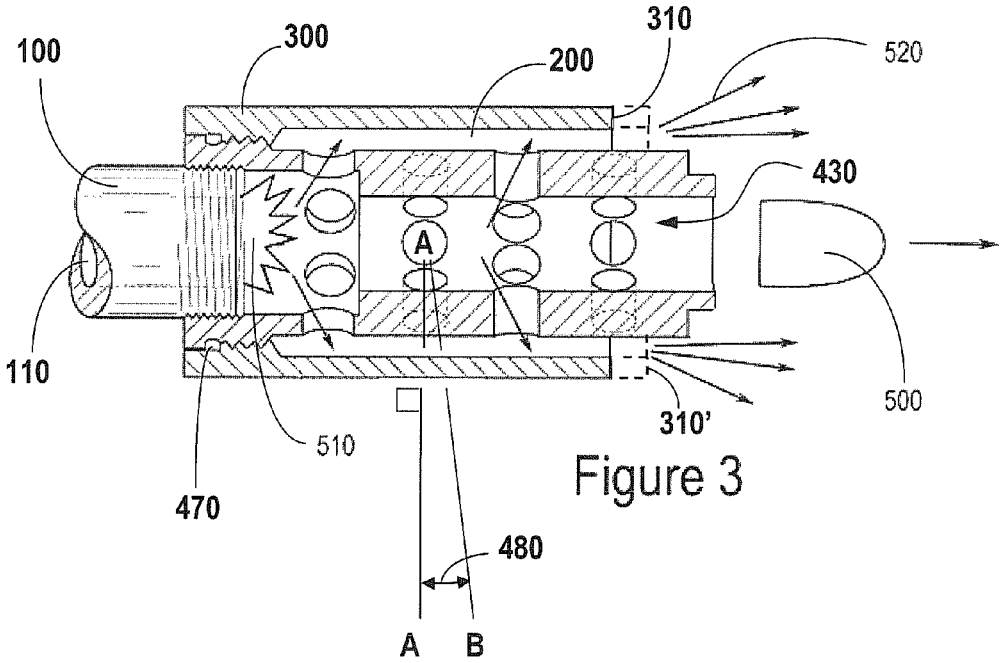
FIG. 3 is a cut-away side perspective view of the preferred embodiment in operation.

When a person fires a projectile 500, the expanding propellant gases 510 exit the firearm muzzle 120 and enter ported inner tube 400 (as shown in FIG. 3) which is integral with the firearm muzzle 120 when muzzle brake 10 is attached. The expanding propellant gases 510 continue through the inner tube bore 430, and, due to their expansive character, some of the expanding propellant gases 510 will exit the inner tube bore 430 through the exhaust ports 440, 450. As the expanding propellant gases 510 exit the inner tube bore 430, they enter the gas expansion chamber 200, which is a tubular space formed between the outer surface periphery of inner tube bore 430 and the inner periphery of outer shield tube 300.

Inner tube flange 470 is formed at the proximal end of ported inner tube 400. Inner tube flange 470 is located proximal to mating threads 410, and when muzzle brake 10 is operatively assembled, inner tube flange 470 contacts mating threads 310 to form a sealing relationship at the proximal end of outer shield tube 300.

The gas expansion chamber 200 provides a path for the exhaust of expanding propellant gases 510 resulting from the discharge of a round of ammunition. The gas expansion chamber 200 is closed at its proximal end such that when expanding propellant gases 510 enter the gas expansion chamber 200, the only exit path is through the distal end of muzzle brake 10. Additionally, the gas expansion chamber 200 provides a space that is configured so as to reduce the velocity of the expanding propellant gases 510. This reduction in velocity of the expanding propellant gases 510 is a factor in reducing felt recoil and reducing the tendency for the firearm muzzle 120 to rise when firing.

Ported inner tube 400 is generally contained within the outer shield tube 300 and secured in place via inner to outer shield tube threads 410 which mate with the corresponding outer shield tube threads 310 of muzzle brake 10. In a preferred embodiment, as shown in FIG. 3, and represented by outer shield tube termination 310, ported inner tube 400 may extend beyond the distal end of outer shield tube 300, such that exhaust ports 440 are not entirely enclosed by outer shield tube 300. In other embodiments, also shown in FIG. 3, and represented by outer shield tube termination 310', inner tube 400 may terminate at the distal end of outer shield tube 300. In still other non-illustrated embodiments, the distal end of inner tube 400 may terminate at a point that is proximal to the distal end of outer shield tube 300.

Muzzle brake 10 attaches to the muzzle end of a firearm barrel 100 by means of threads 420 to secure muzzle brake 10 to a firearm barrel 100 and securely align the inner tube bore 430 with the firearm barrel bore 110. A person of skill in the art would readily appreciate that other means of securing the outer shield tube 300 to the ported inner tube 400 exist. Furthermore, a person of skill in the art would recognize that other means of securing ported inner tube 400 to the firearm barrel 100 exist.

In the illustrated preferred embodiment, which is by way of example and in no way limiting upon the invention, the exhaust ports 440, 450 present in ported inner tube 400 exist as cylindrical channels, but a person of skill in the art would readily appreciate that other configurations exist. Said other communications may exist as non-circular holes, perforations, slots, channels or other designs which effectively allow for the transfer of expanding propellant gases 510 from the lumen of ported inner tube 400 into the gas expansion chamber 200.

In the illustrated non-limiting embodiment, the exhaust ports 440, 450 extend perpendicular to the long axis of ported inner tube 400 and penetrate the wall of ported inner tube 400 to provide a route of passage from the inner tube bore 430 into the gas expansion chamber 200.

However, in other embodiments, the cylindrical holes or other communications may perforate the wall of the inner tube at various angles which are not perpendicular to the longitudinal axis of muzzle brake 10 as is shown in FIG. 3. Line A shows exhaust ports 440, 450 at a 90° angle to the longitudinal axis of muzzle brake 10. Line B shows that exhaust ports 440, 450 may penetrate inner tube 400 at an angle other than perpendicular to the longitudinal axis of inner tube 400, as shown by angle 480, which is approximately 2-7° canted forward from the perpendicular. Furthermore, by way of non-illustrated and non-limiting example, the holes, perforations or other communications may be canted forward or rearward from a 0 to 45 degree angle to the perpendicular. In further non-illustrated example embodiments, the holes, perforations or other communications may be of different, mixed diameters or configurations within a single muzzle brake 10 so as to further optimize the effectiveness of muzzle brake 10. A person of skill in the art would immediately recognize that varying the angle or the configuration of the penetrating communications is immediately obvious.

The exhaust ports 440, 450 serve to provide an open channel between the inner tube bore 430 and the gas expansion chamber 200 through which expanding propellant gases 510 produced by the discharge of a firearm may be directed and channeled. In one embodiment, the perforations exist as cylindrical holes of from 0.01 inches to 0.50 inches, but this is in no way limiting upon the invention, and a person of skill in the art would instantly recognize that these holes may be of other diameters or configurations.

In the illustrated embodiment, which is for example only and is in no way limiting upon the device of the present invention, ported inner tube 400 is configured with a series of four (4) concentric rows of exhaust ports 440, 450. In other non-illustrated embodiments, the perforations or communicating holes may exist in other configurations from one (1) row to multiple concentric rows extending from the proximal to the distal end of the muzzle brake and may be of a configuration other than cylindrical perforations. In still other non-illustrated embodiments, the perforations or communications may exist in a non-concentric configuration, for example, aligned along the upper or lower portion of ported inner tube 400 so as to direct expanding propellant gases 510 in a preferred direction.

Figure 2:
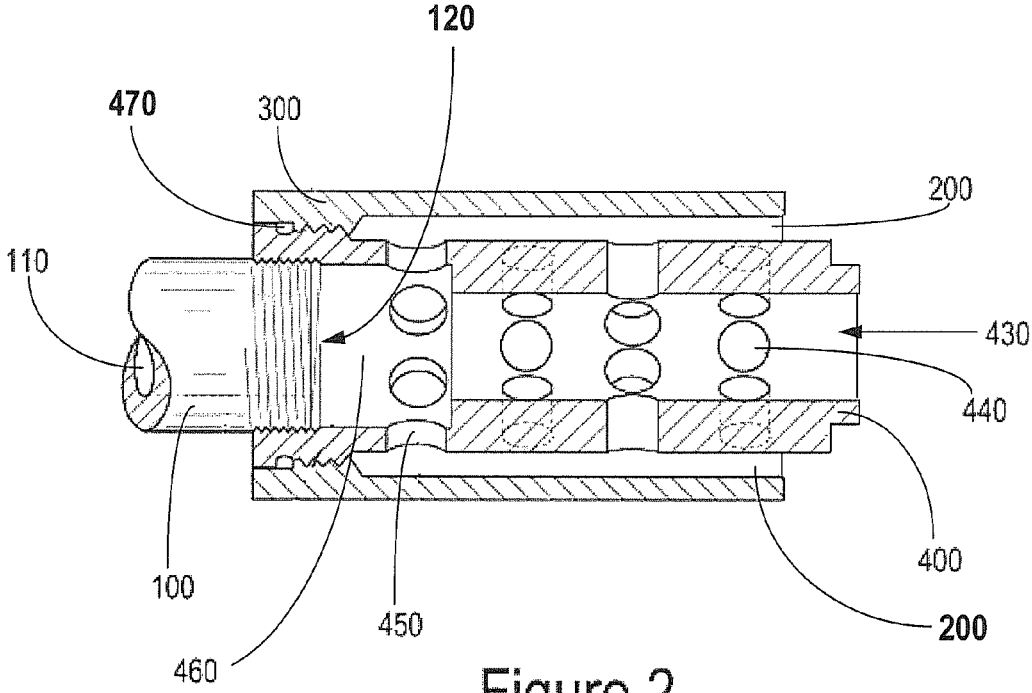
FIG. 2 is a cut-away side perspective view of the preferred embodiment as assembled.

Referring now to FIGS. 2 & 3, when a projectile 500 is fired through the firearm barrel 100, the expanding propellant gases 510, resulting from the burning of gunpowder, are trapped behind the projectile 500 and provide the energy necessary to propel the projectile 500 forward, through and out of the firearm barrel 100. As the projectile 500 leaves the barrel muzzle 120, it enters into the inner tube bore 430 of muzzle brake 10 which is attached to the firearm barrel 100 via mating threads 420 or other means recognized by persons of skill in the art.

In a preferred embodiment, the inside diameter of the inner tube bore 430 approximates the bore diameter, or is slightly larger than, the bore of the firearm barrel 100 to which it is attached. This slightly larger diameter may be from 0.001 inches to 0.50 inches over the bore size of the firearm barrel 100. In a preferred embodiment, which is for illustrative purposes only and is in no way limiting upon the scope of the invention, the diameter of the inner tube bore 430 exists as 0.01 inches to 0.50 inches overbore from the diameter of the bore of the firearm barrel 100.

As the projectile proceeds down the inner tube bore 430, expanding propellant gases 510, which were trapped behind the projectile 500, are exhausted through the exhaust ports 440, 450 and into the gas expansion chamber 200 and against the inner periphery of outer shield tube 300. Since the gas expansion chamber 200 is closed at its proximal end, the expanding propellant gases 510 ultimately will be exhausted out of the forward (distal) end 520 of muzzle brake 10.

By directing the expanding propellant gases 510 to exit out of the forward end 520 of muzzle brake 10, the flash produced by the expanding propellant gases 510 will be similarly directed. This may result in reducing the amount of flash visible to the shooter who uses muzzle brake 10, correspondingly reducing or eliminating any effect such flash may have on night vision equipment (such as flash blindness) when such night vision equipment is utilized by the shooter.

Another advantage to directing the expanding propellant gases 520 in this way is that the sound produced when the expanding propellant gases 520 exit the forward end 520 of muzzle brake 10 also may be, at least partially, diverted in the same direction. This diversion of the sound may reduce the noise level perceived by the shooter when muzzle brake 10 is used.

In the illustrated embodiment, which is by way of example and is in no way limiting on the scope of the invention, muzzle brake 10 comprises an inner tube plenum 460 which may be of a diameter larger than the inner tube bore 430 or the firearm barrel bore 110. The inner tube plenum 460 may be tailored to the firearm and ammunition characteristics so as to provide the maximum effectiveness of muzzle brake 10. In such embodiments, a first row of exhaust ports 450 exist which are tailored to the characteristics of the inner tube plenum 460 and may be of configuration or dimensions other than the subsequent exhaust ports 440. In other non-illustrated embodiments, the inner tube bore 430 of muzzle brake 10 approximates and mates directly to the bore of the firearm, minimizing or negating the inner tube plenum 460.

In a preferred embodiment, the diameter of inner tube bore 430 narrows immediately forward (distal) of the inner tube plenum 460. This diameter approximates the outer diameter of the caliber of the projectile being fired, based on the caliber of the projectile for which the firearm is designed to fire. The diameter of inner tube bore 430 from the distal end of inner tube plenum 460 to the distal end of muzzle brake 10 is preferably sized 0.001 inches to 0.50 inches larger than the caliber of the projectile, although a person of skill in the art would readily appreciate that other sizes may be used.

Figure 4:
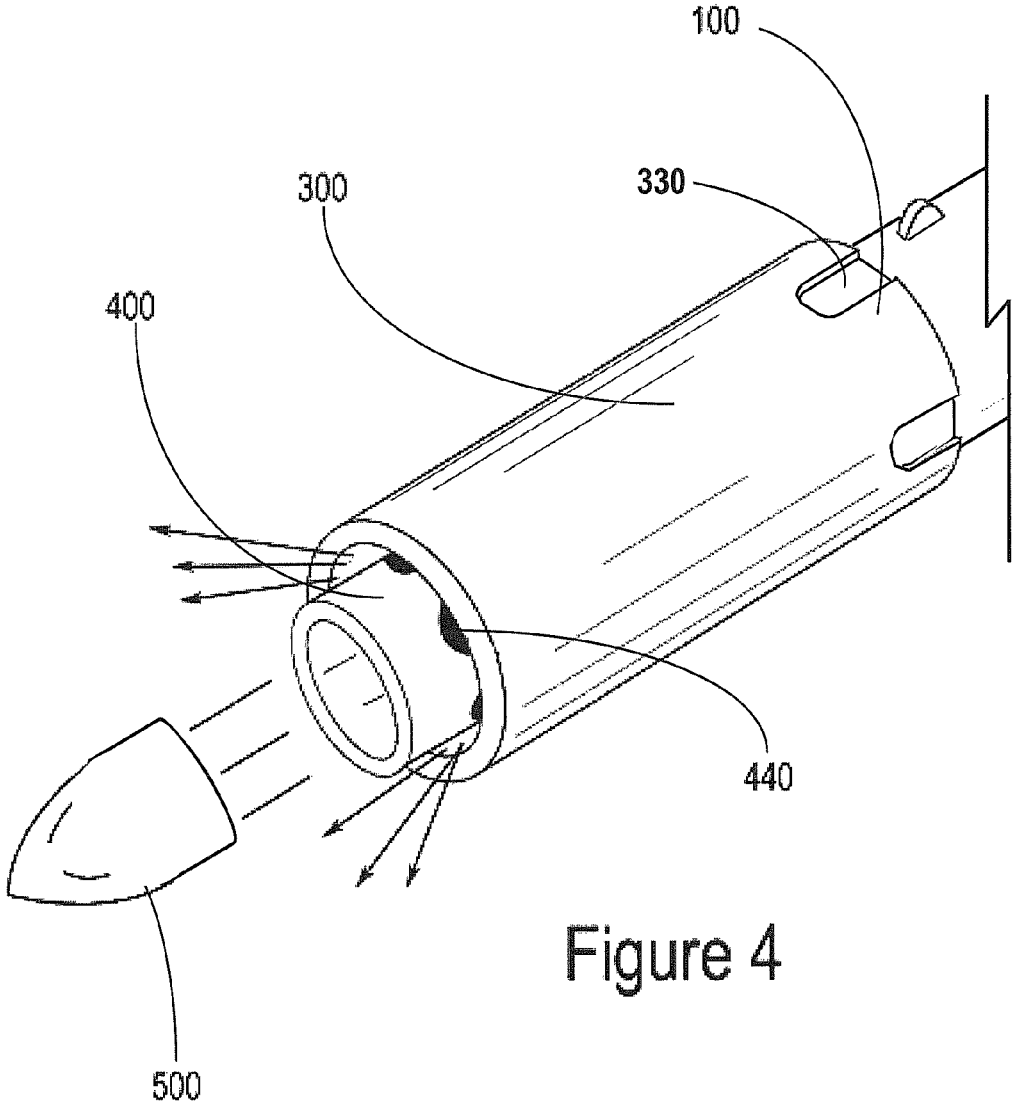
FIG. 4 is a perspective view of the preferred embodiment in operation.

Referring now to FIGS. 3 & 4, as the projectile 500 passes through muzzle brake 10, the expanding propellant gases 510 are exhausted through the exhaust ports 440, 450 into the gas expansion chamber 200, which is formed by ported inner tube 400 and the outer shield tube 300. By diverting the expanding propellant gases 510, first through exhaust ports 440, 450 in a direction generally perpendicular to the longitudinal axis of muzzle brake 10 and the firearm barrel 100, and subsequently through inner tube bore 430 in a direction generally parallel to the said longitudinal axis, the force exerted backward (felt recoil) is thereby reduced. In the preferred embodiment, the outer shield tube 300 is not perforated, but one of skill in the art would recognize that other configurations may exist wherein the outer shield tube 300 may contain perforations or other communications which may connect the gas expansion chamber 200 to the surrounding atmosphere.

As shown in FIG. 3, the distal end of outer shield tube 300 preferably terminates at outer shield tube termination 310, such that at least a portion of exhaust ports 440 extend beyond the outer shield tube termination 310. In this configuration, a portion of expanding propellant gases 510 being exhausted through exhaust ports 440 would not contact outer shield tube 300, and therefore would not be diverted in a forward direction by outer shield tube 300. Such expanding propellant gases 510 would then freely exit inner tube bore 430 into the surrounding atmosphere.

FIG. 3 also shows an alternative embodiment whereby the distal end of outer shield tube 300 extends to a length shown by outer shield tube termination 310'. In this alternative embodiment, outer shield tube 300 would completely cover exhaust ports 440 such that no part of them would extend beyond the end of outer shield tube 300. One of skill in the art would recognize that other configurations may exist regarding the length of the outer shield tube 300 in relation to ported inner tube 400 while maintaining the efficiency and purpose of muzzle brake 10.

Referring to FIG. 4, the outer shield tube 300 may include a plurality of slots 330 that are machined on the proximal outer surface of outer shield tube 300. These slots 330 may serve to assist a person when installing or removing the outer shield tube 300. The slots 330 may be of a size, shape and position so as to allow a person to use a number of existing tools, including known so-called tactical wrenches, designed for use on firearms. Such tools may utilize the slots 330 as gripping points which allow a person to tighten or loosen the outer shield tube 300 in relation to its connection with ported inner tube 400.

In a preferred embodiment, the gas expansion chamber 200 directs exhausted propellant gases 510 along the longitudinal axis of the gas expansion chamber 200 in a direction roughly parallel to the longitudinal axis of muzzle brake 10 and out of the front (distal) end 520 of muzzle brake 10.

Figure 5:
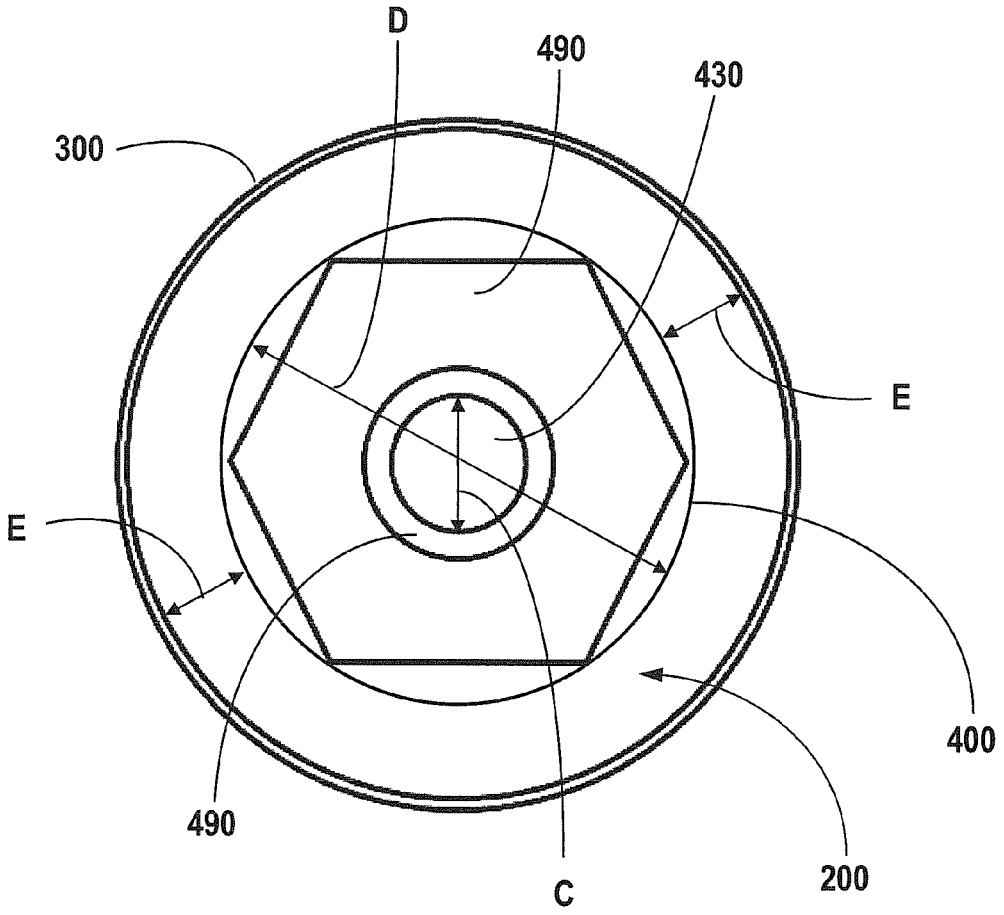
FIG. 5 is an end-on elevation view showing the muzzle brake embodiment as viewed from the distal end of the preferred embodiment, as operatively assembled.

Referring to FIG. 5, line C represents the inner diameter of the inner tube bore 430. In a preferred embodiment, this diameter may be in the range of 0.10 to 0.50 inches. Line D represents the outer diameter of inner tube bore 430. In a preferred embodiment, this diameter may be in the range of 0.50 to 1.0 inches. In a preferred embodiment, the outer shield tube 300 has an inner diameter approximately 1-2 inches as represented by line E. However, one of skill in the art would recognize that other inner and outer diameters for the inner tube bore 430 and ported inner tube 400, as well as other diameters for the outer shield tube 300, could be utilized, and muzzle brake 10 would still maintain its operational objectives of reducing recoil and stabilizing the barrel.

In a preferred embodiment, the cross-sectional surface area of gas expansion chamber 200 may be five to fifty times greater than the cross-sectional surface area of inner tube bore 430. In other embodiments, the cross-sectional surface area of gas expansion chamber 200 may be two to five times greater than the cross-sectional surface area of inner tube bore 430.

In the preferred embodiments, the distal end 490 of ported inner tube 400 has a hexagonal shape. This shape allows a user of muzzle brake 10 to more easily disconnect the outer shield tube 300 from ported inner tube 400 when muzzle brake 10 is operatively assembled and connected to a firearm. The user may use a tool, such as a wrench, to hold the distal end 490 of ported inner tube 400 while simultaneously loosening the outer shield tube 300.

In the preferred embodiments, the distal end 480 of inner tube bore 430 has a beveled edge that angles inward to the inner tube bore 430. One of skill in the art would recognize that other edge types, such as a flat edge, may be used and are within the scope of the present invention.

In another, non-illustrated embodiment, the muzzle brake comprises an inner perforated tube and outer unperforated shield tube which is open at the distal end of the muzzle brake. The inner tube of this embodiment is bored to a preliminary diameter of between 0.10 inches to 0.30 inches and is supplied to an end user in an unfinished form. This unfinished form is to be customized by further forming the longitudinal diameter of the inner tube to a diameter appropriate for the specific desires of the end user.

While the foregoing written description of the invention enables one of ordinary skill in the art to make and use what is considered presently to the be the best mode thereof, those of ordinary skill in the art will understand and appreciate the existence of variations, combinations, and equivalents of the specific embodiment, method, and examples herein. The invention therefore should not be limited by the above described embodiment, method, and examples, but by all embodiments and methods within the scope and spirit of the invention.

The invention claimed is:

1. A muzzle brake for stabilizing the muzzle end of a firearm barrel and reducing felt recoil of the firearm, comprising:

an elongate inner tube having a cylindrical wall, said inner tube having a plurality of exhaust ports along its longitudinal dimension, said plurality of exhaust ports penetrating through the cylindrical wall of said inner tube at an angle generally between 2-7° canted forward from the perpendicular to the longitudinal axis of said inner tube; and an outer shield tube having an inner diameter that is larger than an outer diameter of said elongate inner tube, said outer shield tube being coaxially mountable relative to said elongate inner tube in a manner such that said outer shield tube substantially circumferentially surrounds said elongate inner tube, said outer shield tube comprising an unperforated metal tube;

said inner tube having a threaded screw fitting generally on the proximal circumferential inner surface of said inner tube, said threaded screw fitting being configured for attachment of said muzzle brake to a firearm barrel;

said inner tube further defining a plenum, wherein said plenum is formed as a space generally distal to said threaded screw fitting on the proximal circumferential inner surface of said inner tube, and wherein the diameter of said plenum approximates the diameter of a firearm muzzle;

said inner tube further having an inner tube bore generally integral with and distal to said plenum, and wherein said inner tube bore is open to the atmosphere at its distal end and has a diameter between 0.001-0.50 inches larger than the diameter of a projectile that passes therethrough;

said inner tube having a generally hexagonal shape at the distal end of said inner tube, for aiding in disconnecting said outer shield tube from said inner tube when said muzzle brake is operatively assembled and attached to a firearm barrel;

said inner tube further having a threaded screw fitting on the proximal circumferential outer surface of said inner tube;

said outer tube having a threaded screw fitting on the proximal circumferential inner surface of said outer shield tube configured for connection of said outer shield tube to said inner tube;

the proximal outer surface of said outer tube being provided with a plurality of machined slots orthogonally spaced around the proximal outer surface of said outer shield tube, said plurality of machined slots having a semi-elliptical shape, said plurality of machined slots being configured for aiding in the installation and removal of said outer shield tube;

said inner tube further comprising a circumferential flange at its proximal end that affects a sealing engagement with the proximal end of said threaded screw fitting on the circumferential proximal inner surface of said outer shield tube, wherein the distal end of said inner tube extends beyond the distal end of said outer shield tube, such that a fractional portion of some of said a plurality of exhaust ports located closest to the distal end of said inner tube are not wholly enclosed by said outer shield tube; and said outer tube and said inner tube defining a gas expansion chamber therebetween, said gas expansion chamber being formed as a space between the outer surface of said inner tube and the inner surface of said outer shield tube, wherein a transverse cross-sectional surface area of said gas expansion chamber is at least three times larger than a coplanar cross-sectional surface area of said inner tube bore.

2. The muzzle brake as in claim 1, wherein said a plurality of exhaust ports enter said inner tube at an angle perpendicular to the longitudinal axis of said inner tube.

* * * * *